US005981083A

United States Patent [19]

Colvin et al.

[11] Patent Number: 5,981,083

[45] Date of Patent: Nov. 9, 1999

[54] METHOD OF MAKING COMPOSITE CASTINGS USING REINFORCEMENT INSERT CLADDING

[75] Inventors: Gregory N. Colvin; Stewart J. Veeck; Donald E. Larsen, Jr., all of Muskegon, Mich.; William R. Freeman, Jr., Easton, Conn.

[73] Assignee: Howmet Corporation, Greenwich, Conn.

[21] Appl. No.: 08/949,658

[22] Filed: Oct. 14, 1997

Related U.S. Application Data

[60] Division of application No. 08/374,037, Jan. 18, 1995, Pat. No. 5,678,298, which is a continuation-in-part of application No. 08/111,081, Aug. 24, 1993, abandoned, which is a continuation-in-part of application No. 08/002,104, Jan. 8, 1993, Pat. No. 5,241,738.

[51] Int. Cl.[6] ..... B32B 5/24; B32B 15/14; C22C 1/09

[52] U.S. Cl. ..... 428/608; 428/614; 428/660

[58] Field of Search ..... 428/608, 614, 428/660, 611, 662

[56] References Cited

U.S. PATENT DOCUMENTS

| | | | |
|---|---|---|---|
| 1,043,831 | 11/1912 | Heinkel et al. | 428/614 |
| 1,056,694 | 3/1913 | Krause . | |
| 1,125,161 | 1/1915 | Page | 428/614 |
| 1,722,281 | 7/1929 | During . | |
| 1,911,040 | 5/1933 | Schultz . | |
| 1,926,770 | 9/1933 | Harris et al. | 428/614 |
| 2,084,247 | 6/1937 | Dockray et al. . | |
| 2,161,116 | 6/1939 | White . | |
| 2,745,437 | 5/1956 | Comstock, III | 138/64 |
| 2,962,813 | 12/1960 | Kreidler . | |
| 3,257,177 | 6/1966 | Kanter | 428/614 |
| 3,352,650 | 11/1967 | Goldstein et al. . | |
| 3,480,465 | 11/1969 | Imabayashi et al. | 164/75 X |
| 3,553,820 | 1/1971 | Sara | 428/614 |
| 3,596,703 | 8/1971 | Bishop et al. | 164/132 |
| 3,659,645 | 5/1972 | Rose | 164/353 |
| 3,720,257 | 3/1973 | Beutler et al. | 164/75 |
| 3,815,660 | 6/1974 | Gallagher et al. | 164/112 |
| 3,819,145 | 6/1974 | Huber et al. | 164/334 |
| 3,847,558 | 11/1974 | Trabacco et al. | 29/191.4 |
| 3,863,701 | 2/1975 | Niimi et al. | 164/98 |
| 3,921,702 | 11/1975 | Ward, III | 164/112 |
| 3,963,450 | 6/1976 | Davies | 428/614 |
| 4,008,052 | 2/1977 | Vishnevsky et al. | 164/100 |
| 4,055,451 | 10/1977 | Cockbain et al. | 156/89 |
| 4,140,096 | 2/1979 | Dunn et al. | 123/193 |
| 4,186,479 | 2/1980 | Gutris . | |
| 4,487,246 | 12/1984 | Frasier | 164/32 |
| 4,502,524 | 3/1985 | Iwanami et al. | 164/66.1 |

(List continued on next page.)

FOREIGN PATENT DOCUMENTS

| | | | |
|---|---|---|---|
| 58-61959 | 4/1983 | Japan . | |
| 58-209464 | 12/1983 | Japan . | |
| 59-82157 | 5/1984 | Japan . | |
| 59-212160 | 12/1984 | Japan . | |
| 60-158968 | 8/1985 | Japan . | |
| 61-130439 | 6/1986 | Japan | 164/100 |
| 569384 | 8/1977 | Russian Federation | 164/100 |
| 16 286 | of 1913 | United Kingdom . | |
| 2 098 112 | 11/1982 | United Kingdom . | |
| 2 219 006 | 11/1989 | United Kingdom . | |

*Primary Examiner*—John J. Zimmerman

[57] ABSTRACT

A method of making a casting reinforced with a reinforcement insert, such as a fiber reinforced metal matrix composite insert or intermetallic insert therein, wherein a preformed fiber reinforced metal matrix composite reinforcement insert is clad or covered with a material that is effective to avoid the aforementioned adverse reactions between the insert/melt and any exposed insert fibers/matrix, the clad insert is suspended in the mold cavity, a melt is introduced into the mold cavity about the clad insert, and the melt is solidified about the clad insert to provide a casting of the solidified melt having the clad insert disposed therein to reinforce the casting.

6 Claims, 11 Drawing Sheets

U.S. PATENT DOCUMENTS

| | | | |
|---|---|---|---|
| 4,572,270 | 2/1986 | Funatani et al. | 164/97 |
| 4,811,778 | 3/1989 | Allen et al. | 164/516 |
| 4,816,347 | 3/1989 | Rosenthal et al. | 428/615 |
| 4,867,644 | 9/1989 | Wright et al. | 416/230 |
| 4,871,008 | 10/1989 | Dwivedi et al. | 164/6 |
| 4,875,616 | 10/1989 | Nixdorf | 228/120 |
| 4,889,177 | 12/1989 | Charbonnier et al. | 164/97 |
| 4,932,099 | 6/1990 | Corwin | 164/97 |
| 5,097,887 | 3/1992 | Schmid et al. | 164/100 X |
| 5,241,737 | 9/1993 | Colvin | 29/526.2 |
| 5,241,738 | 9/1993 | Colvin | 29/526.2 |
| 5,260,137 | 11/1993 | Rosenthal et al. | 428/608 |
| 5,263,530 | 11/1993 | Colvin | 164/100 |
| 5,295,528 | 3/1994 | Diyecha et al. | 164/75 |
| 5,377,742 | 1/1995 | Jarry | 164/100 |

METHOD OF MAKING COMPOSITE CASTINGS USING REINFORCEMENT INSERT CLADDING

CROSS REFERENCE TO RELATED APPLICATIONS

This application is a division of application Ser. No. 08/374,037 filed Jan. 18, 1995, now U.S. Pat. No. 5, 678, 298, which is a continuation-in-part of application Ser. No. 08/111,081 filed Aug. 24, 1993, abandoned, which is a continuation-in-part of application Ser. No. 08/002,104 filed Jan. 8, 1993, now U.S. Pat. No. 5,241,738.

FIELD OF THE INVENTION

The present invention relates to a method of making a composite casting, as well as casting produced thereby, having a preformed reinforcement insert bonded in a preselected position therein.

BACKGROUND OF THE INVENTION

Components for aerospace, automotive and like service applications have been subjected to the ever increasing demand for improvement in one or more mechanical properties while at the same time maintaining or reducing the weight of the component. To this end, the Charbonnier et al. U.S. Pat. No. 4 889 177 describes a method of making a composite casting wherein a molten lightweight alloy, such as magnesium or aluminum, is countergravity cast into a gas permeable sand mold having a fibrous insert of high strength ceramic fibers positioned therein by metallic seats so as to be incorporated into the casting upon solidification of the molten alloy.

The Funatani et al. U.S. Pat. No. 4 572 270 describes a method of making a composite casting to this same end wherein a mass of high strength reinforcing fibers, such as ceramic fibers, whiskers, or powder is incorporated into a lightweight metal matrix (e.g. aluminum or magnesium) that is die cast around the reinforcing mass in a pressure chamber.

A technique commonly referred to as bicasting has been employed in attempts to improve one or more mechanical properties of superalloy castings for use as aerospace components. Bicasting involves pouring molten metal into a mold cavity in which a preformed insert is positioned in a manner to augment one or more mechanical properties in a particular direction(s). The molten metal surrounds the insert and, upon solidification, yields a selectively reinforced casting comprising the insert embedded in and hopefully soundly bonded with the cast metal without contamination therebetween. However, as described in U.S. Pat. No. 4 008 052 attempts at practicing the bicasting process have experienced difficulty in consistently achieving a sound metallurgical bond between the insert and the metal cast thereabout without bond contamination. Moreover, difficulty has been experienced in positioning the insert in the mold cavity and thus the final composite casting within required tolerances. The inability to achieve on a reliable and reproducible basis a sound, contamination-free bond between the insert and the cast metal has significantly limited use of bicast components in applications, such as aerospace components, where reliability of the component in service is paramount.

When a fiber reinforced metal matrix composite is used as the preformed insert in the bicasting process, reinforcing fibers exposed by machining the insert can react with the metal matrix during the transient thermal exposure imposed by bicasting. These reactions can adversely affect the reinforcing capabilities of the insert in the final bicast product.

It is an object of the present invention to provide an improved bicasting type of process for making a composite casting reinforced by a reinforcement insert, such as a fiber reinforced metal matrix composite insert or intermetallic reinforcement insert (e.g. a titanium aluminide insert), wherein a sound, void-free metallurgical bond is reliably and reproducibly produced between the reinforcement insert and the cast metal and wherein adverse reactions between the insert and the molten metal and between any exposed insert fibers and the insert matrix are reduced or eliminated.

SUMMARY OF THE INVENTION

The present invention provides a method of making a casting reinforced with a reinforcement insert, such as a fiber reinforced metal matrix composite insert or intermetallic insert therein, wherein a preformed fiber reinforced metal matrix composite reinforcement insert is clad or covered with a material that is effective to avoid the aforementioned adverse reactions between the insert/melt and any exposed insert fibers/matrix, the clad insert is suspended in the mold cavity, a melt is introduced into the mold cavity about the clad insert, and the melt is solidified about the clad insert to provide a casting of the solidified melt having the clad insert disposed therein to reinforce the casting. The invention preferably involves the further step of subjecting the casting to elevated temperature and isostatic gas pressure conditions to produce a void-free metallurgical bond between the clad insert and the solidified melt.

In one embodiment of the invention, the clad insert is suspended in the mold cavity by at least one elongated, slender suspension member fixed (e.g. welded) at one end to the insert cladding and fixed at another end to the mold.

In another embodiment of the invention, the reinforcement insert is clad with a material that reacts with the metal matrix to form a ductile region between the insert and the solidified melt while being compatible with the melt so as not to adversely affect the composition thereof or properties of the casting formed when the melt is solidified.

In a particular embodiment of the invention, the reinforcement insert comprises a fiber reinforced titanium matrix composite insert or a titanium aluminide insert clad or covered with a metal that is a titanium beta phase stabilizer to provide a relatively ductile beta stabilized region between the insert and a solidified titanium based melt forming the casting. The metal or covering cladding can comprise Nb or Ta, such as Nb or Ta foil, and other suitable refractory metals and alloys to this end.

The present invention also provides a composite casting comprising a fiber reinforced metal matrix composite reinforcement insert or intermetallic insert embedded in metallic or intermetallic melt solidified thereabout and having the aforementioned cladding between the insert and solidified melt.

For example, a composite casting comprises a fiber reinforced metal matrix composite reinforcement insert or intermetallic insert embedded in metallic or inter metallic melt solidified thereabout and having cladding between the insert and solidified melt and reacted with the metal matrix to provide a relatively ductile region between the insert and solidified melt.

A particular composite casting of the invention comprises a fiber reinforced titanium based matrix composite reinforcement insert or titanium aluminide insert embedded in a titanium based melt solidified thereabout and having cladding comprising a titanium beta phase stabilizer between the insert and solidified melt and reacted with the titanium based matrix of the insert to provide a relatively ductile beta stabilized region between the insert and solidified melt.

The present invention also provides a method of making a titanium based casting reinforced with a titanium based reinforcement insert wherein the insert is suspended in a melt-receiving casting mold cavity and wherein the ratio of the volume of the casting mold cavity to the volume of the reinforcement insert in the volume immediately adjacent to and surrounding the insert is about 16:1 or less, a titanium based melt is introduced into the casting mold cavity about the clad insert, and the melt is solidified about the clad insert to provide a casting of solidified titanium based melt having the titanium based matrix composite reinforcement insert disposed therein to reinforce the casting. Controlling the ratio of the volume of the casting mold cavity to the volume of the reinforcement insert in this manner avoids deleterious interaction between the insert and the melt.

The composite casting thereby produced comprises a titanium based reinforcement insert embedded in a titanium based melt solidified thereabout wherein the ratio of the volume of the solidified melt to the volume of the reinforcement insert is about 16:1 or less.

The aforementioned objects and advantages of the present invention will become more readily apparent from the following detailed description and following drawings.

BRIEF DESCRIPTION OF THE DRAWINGS

FIG. 6*a* is a transverse section (to the long fiber axis) of the microstructure, and FIG. 6*b* is a longitudinal section.

FIG. 7*a* is a transverse section (to the long fiber axis) of the microstructure, and FIG. 7*b* is a longitudinal section.

FIGS. 9*a*, 9*c*, 9*d* are transverse sections (to the long fiber axis) of the microstructure, and FIG. 9*b* is a longitudinal section.

FIGS. 10*a*, 10*b*, 10*c* are transverse sections (to the long fiber axis) of the microstructure, and FIG. 10*d* is a longitudinal section.

FIG. 11*a* is a transverse section (to the long fiber axis) of the microstructure, and FIG. 11*b* is a longitudinal section.

FIG. 12*a* is a transverse section (to the long fiber axis) of the microstructure, and FIG. 12*b* is a longitudinal section.

DETAILED DESCRIPTION

Although the invention is described herebelow with respect to making titanium based (e.g. Ti-6 Al-4 V) composite castings having a preformed fiber reinforced titanium matrix reinforcement insert, the invention is not so limited and can be used to make composite castings comprising other metallic or intermetallic cast materials having a preformed fiber reinforced metal matrix composite reinforcement insert or unreinforced intermetallic reinforcement insert (e.g. a titanium aluminide insert) therein for casting reinforcement purposes.

The following description thus is offered merely for purposes of illustrating and not limiting the present invention.

Bicastings in accordance with one embodiment of the invention wherein the ratio of the volume of the mold cavity to the volume of the reinforcement insert is controlled to be about 16:1 or less were made using TMC (titanium matrix composite) panels as reinforcement inserts precursor material. In particular, two TMC panels were used each comprising 17.8 centimeters by 38.1 centimeters by 8 ply unidirectional SCS-6/Ti-6242 panel having SiC fibers protectively coated with respective C/SiC layers (available as SCS-6 fibers from Textron, Inc.) in a known Ti-6242 alloy matrix.

FIGS. 3*a*–3*d* and 4*a*-4*b* illustrate the microstructure of the as-received panels. Typically, the panels each showed fairly uniform fiber arrays with some fiber contacts. Reaction zones surrounding the fibers were typically on the order of 0.5 microns in thickness. Fiber strengths were determined for each of the panels after removal of the matrix metal (e.g. Ti) by chemical etching. The tensile tests were conducted at room temperature using one inch gage lengths for the tensile specimens. The average of 24 fiber tests from each panel are shown below:

Panel 1 388 ksi tensile strength 20 ksi deviation

Panel 2 446 ksi tensile strength 51 ksi deviation

The panels were chemically milled prior to subsequent processing in a 45% nitric-5% HF acid bath to remove the residual Mo reaction layer on the as-received panels.

Figure 1B:
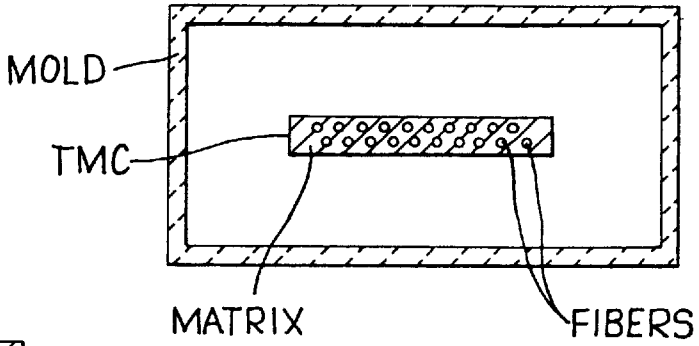
FIG. 1*a* and 1*b* are schematic views illustrating a casting mold having a fiber reinforced metal matrix composite reinforcement insert suspended therein.
Figure 1A:
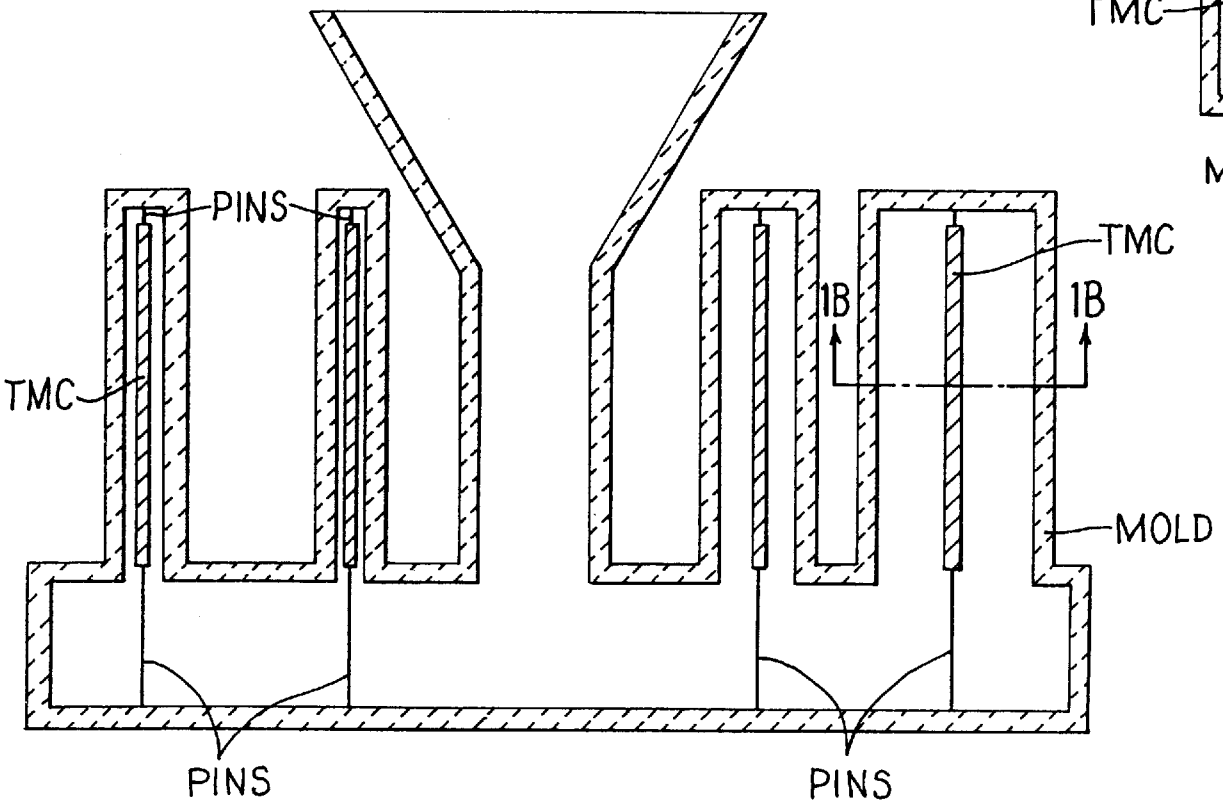

Reinforced bicastings were produced by centrifugally casting two duplicate molds each having 4 mold cavities that had mold cavity thicknesses of approximately 1.0, 1.5, 3.0, and 5.5 centimeters and all a length of 23 centimeters as shown in FIGS. 1*a*-1*b*.

The TMC reinforcement inserts for these molds were fabricated by water-jet cutting each of the chemically milled and cleaned TMC panels into 19 centimeter long by 2.3 centimeter wide strips. A total of 12 strips were obtained from each panel, with residual material from each panel used to conduct baseline metallography and fiber strength evaluations.

Each group of 12 strips was then hot isostatically pressed (HIP'ed) to provide 4 24-ply HIP'ed preformed bars having a thickness of approximately 0.5 centimeter. Consolidation of the strips was performed by stacking them in a "picture frame" steel HIP can or container having outer steel "picture frame" edge members and opposite steel face sheets welded together. Mo foil separators were used between each bar and between the bars and the steel HIP can. The HIP can was He leak inspected, evacuated and sealed prior to HIP consolidation at 1650° F. at 15 ksi for 2 hours.

After HIP consolidation, the 8 bars were removed from the HIP can by water-jet cutting away the outer steel "picture frame" edge members and then chemically etching away the steel face sheets in a 50%—50% nitric acid solution. Due to a slight shifting of the strip stacks during consolidation, the surface of the HIP consolidated bars were ground by a SiC (material) grinding wheel to obtain uniform rectangular cross-section bars. Each ground bar was chemically rinsed in a 10% HF acid bath and dimensionally inspected prior to casting.

Figure 2:
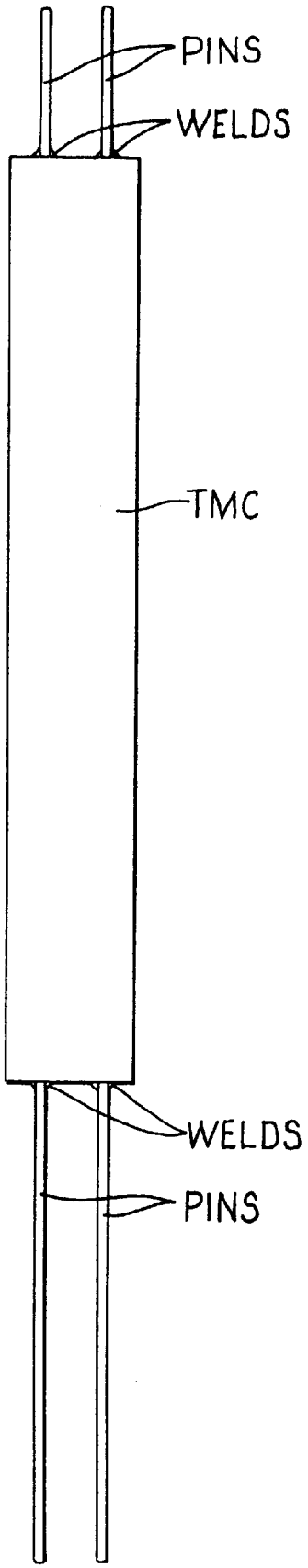
FIG. 2 is an elevational view of a typical titanium matrix composite reinforcement insert used in the casting trials described herein.
Figure 3A:
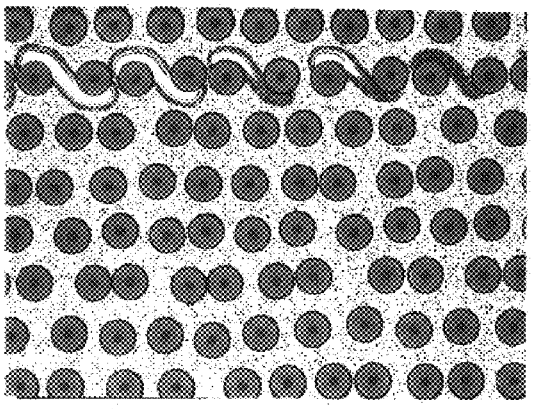
FIGS. 3*a*-3*b* are photomicrographs at 50×and 100× of one type of as-received titanium matrix composite microstructures used as reinforcement inserts in the casting trials described herein. The photomicrographs are taken of the microstructure transverse to the long fiber direction or axis.
Figure 3B:
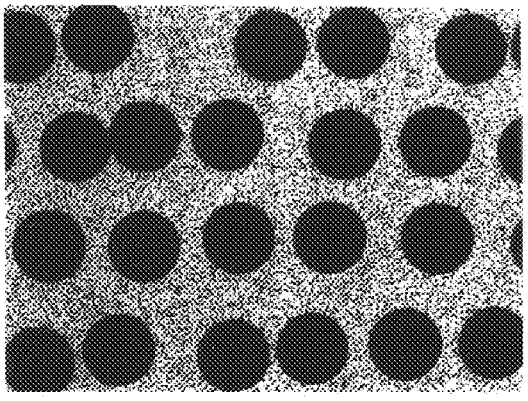
Figure 4A:
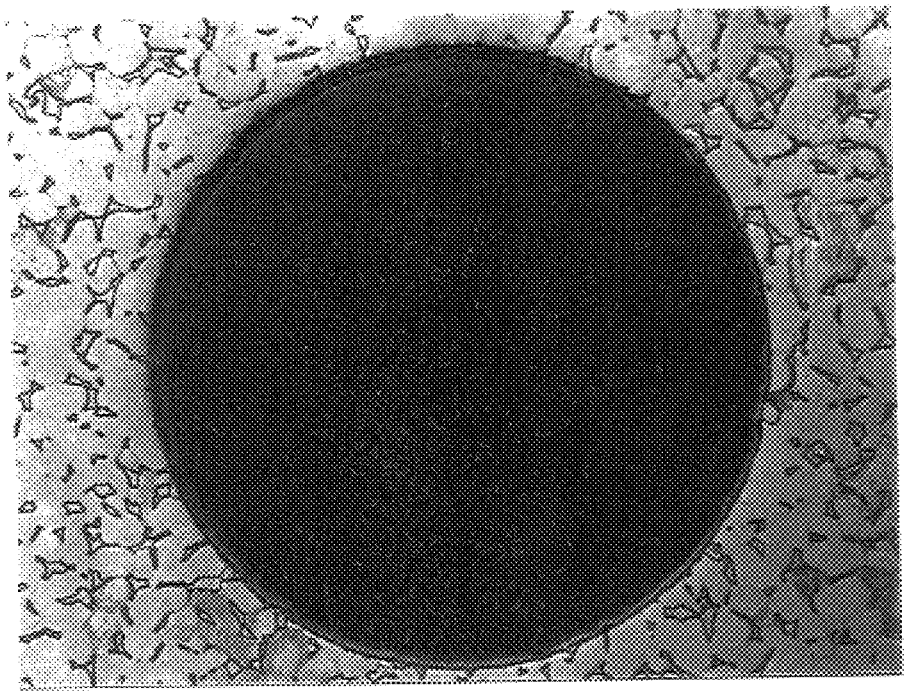
FIGS. 4*a*-4*b* are photomicrographs at 500× and 1000×, respectively, showing typical fiber coating/matrix interaction on the as-received titanium matrix composites. The photomicrographs are taken of the microstructure transverse to the long fiber direction or axis.
Figure 4B:
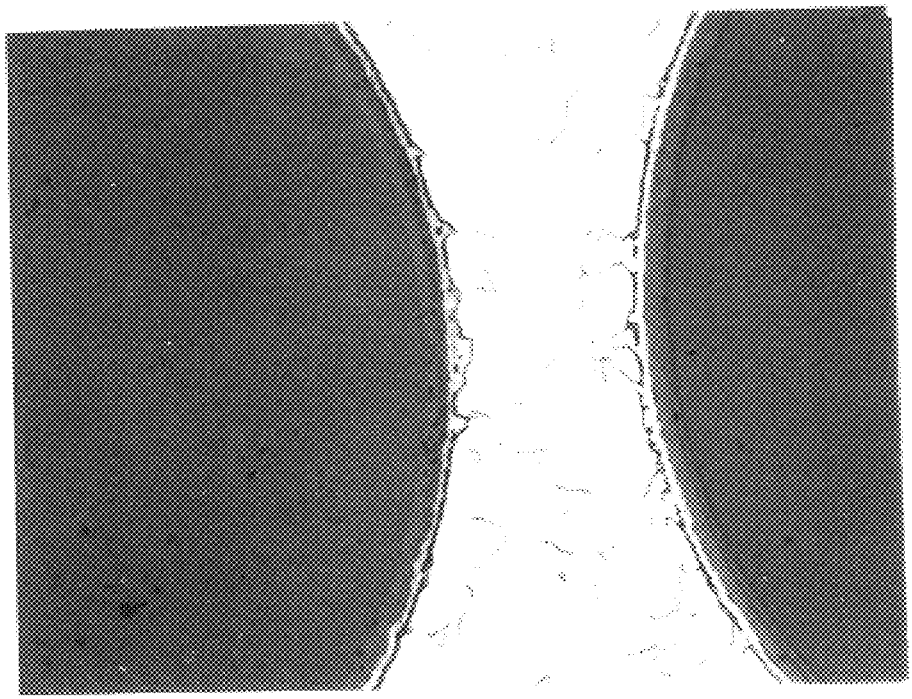

The casting molds used for the casting trials were produced using conventional lost wax procedures. The molds employed bottom gating/top venting as shown in the schematic FIGS. 1*a*-1*b*. Each machined and rinsed TMC preformed bar insert (constituting preformed titanium matrix composite reinforcement insert) was held in place in the respective mold cavity using a pair of Ti-6 Al-4 V pins (diameter of 0.060 inches) welded to the opposite ends of the bars as illustrated in FIG. 2 for a typical preformed insert. The slender pins centered or suspended each preformed bar insert in the respective casting mold cavity of the mold as described in copending Ser. No. 08/002 104, now U.S. Pat. No. 5,241,738 and Ser. No. 07/672 945, abandoned in favor of Ser. No. 07/938 780, now U.S. Pat. No. 5,241,737, of common assignee herewith.

Using the molds and preformed bar inserts described above provided a ratio of the volume of the mold cavity (molten metal) to the volume of the preformed bar insert of 16:1, 32:1, and 58:1.

A Ti6 Al-4 V alloy was VAR melted to a melt casting temperature of the alloy melting point plus 50° F. and was centrifugally cast in the molds preheated to 600° F. Casting was under vacuum.

After melt solidification, the cast molds were knocked out to free the bicastings for sand blasting to remove the shell mold remaining thereon. The bicastings were trimmed to remove residual gating. The resulting plate-shaped bicastings were HIP'ed at 1650° F. at 15 ksi for 2 hours to provide a sound, void-free metallurgical bond between the preformed bar inserts and the solidified melt thereabout. After HIP processing, the plate-shaped bicastings were X-ray inspected to define the insert location within the casting and the quality of the bond between the insert and the solidified melt thereabout. Longitudinal and transverse metallographic specimens were taken 3.8 centimeters from the gating end of the casting to examine the insert in the area of highest thermal input. Also, some castings were water jet machined to remove the preformed bar insert there-from. The insert was then chemically processed in a 45% nitric-5% HF acid solution to etch the matrix metal (Ti) and expose the SiC fibers for tensile testing.

Examination of the castings produced in the manner described above revealed that one of molds had been completely filled with the Ti-6 Al-4 V melt, while the other mold had been only partially filled. As a result, the casting produced in the filled mold had the preformed bar inserts soundly metallurgically bonded with the solidified melt after HIP'ing with no voids at the bond. However, the castings produced in the partially filled mold were not soundly bonded and showed voids at the insert/casting interface because the bond gas seals were not formed about the suspension pins, thereby allowing HIP gas pressure to penetrate the bond interface.

Figure 6A:
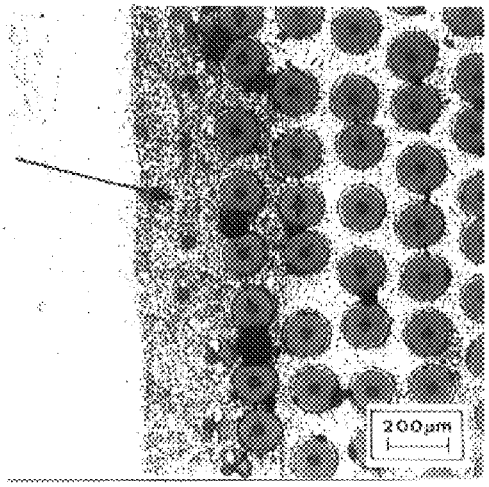
FIGS. 6*a*-6*b* are photomicrographs of a composite casting produced in the mold of FIGS. 1*a* and 1*b* wherein the ratio of the volume of the casting mold cavity to the volume of the insert is outside the range of the invention.
Figure 6B:
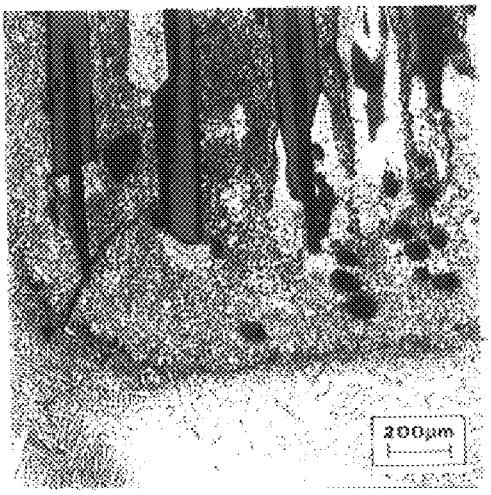

The extent of interaction between the preformed bar inserts and the cast (solidified) melt was determined metallographically. The results revealed the complete dissolution of the insert for the castings having the greatest ratio of volume of molten metal (mold cavity volume) to volume of the insert; i.e. the aforementioned ratio of 58:1. The castings having the intermediate ratio (i.e. 32:1) showed partial dissolution of the preformed bar inserts as illustrated in FIGS. 6*a*-6*b*. In this case, approximately two rows of fibers on the periphery of the insert were completely dissolved and substantial fiber damage was evident in the remainder of the insert in the form of extensive fiber matrix metal reaction zones.

Figure 7A:
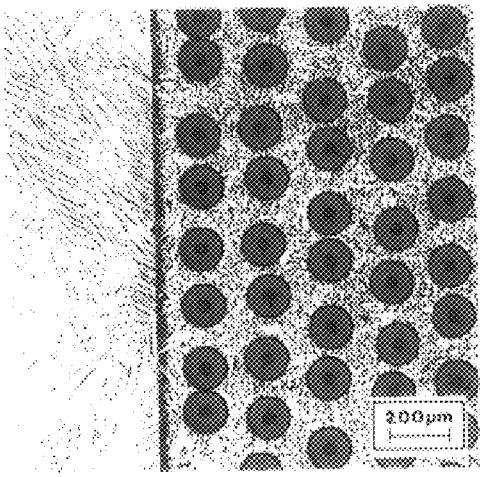
FIGS. 7*a*-7*b* are photomicrographs of a composite casting produced in the mold of FIGS. 1*a* and 1*b* wherein the ratio of the volume of the casting mold cavity to the volume of the reinforcement insert is in accordance with the invention.
Figure 7B:
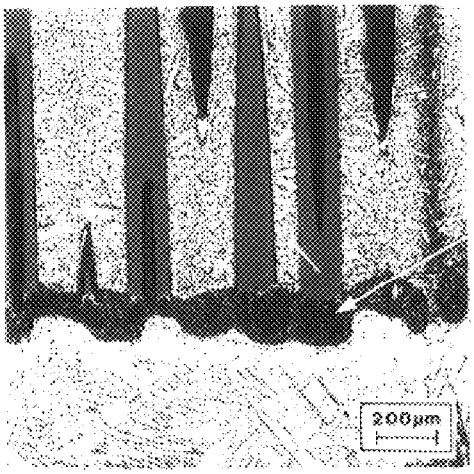

On the other hand, the castings having the smallest ratio of molten metal volume to insert volume (i.e. 16:1 ) showed no signs of insert dissolution as illustrated in FIGS. 7*a*-7*b*. However, in these castings, there were indications of solid state reactions in those areas of the insert where previously machined SiC fibers were exposed. This interaction is shown in FIG. 7*a*-7*b*. The reaction is probably attributed to the decomposition of SiC in contact with Ti matrix to form $Ti_3Si$ and TiC as a result of the thermal exposure during bicasting.

Figure 8:
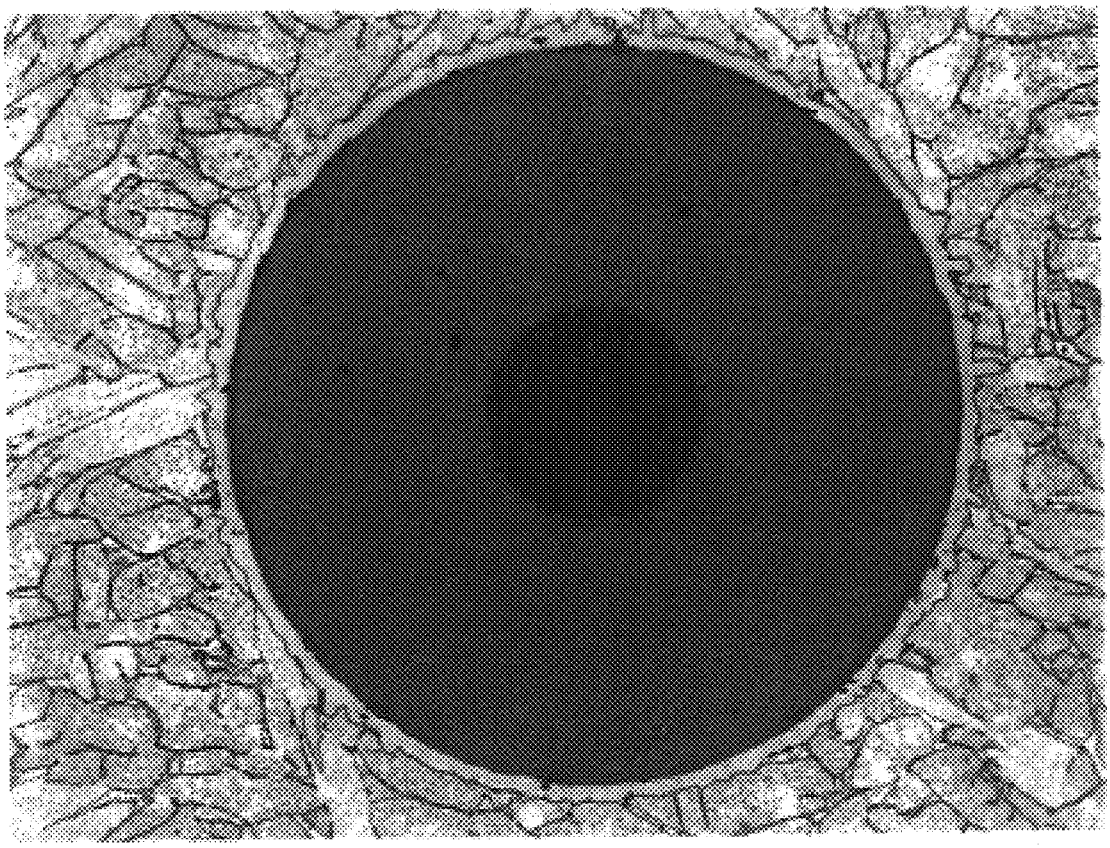
FIG. 8 is a photomicrograph (transverse section) at 500× of a casting showing the fiber coating/matrix reaction zone when cast in accordance with one embodiment of the invention.
Figure 9A:
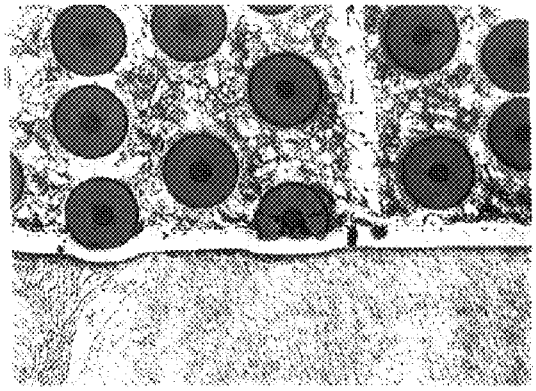
FIGS. 9*a*–9*d* are photomicrographs of a casting having a Ta clad reinforcement insert in accordance with another embodiment of the invention.
Figure 9C:
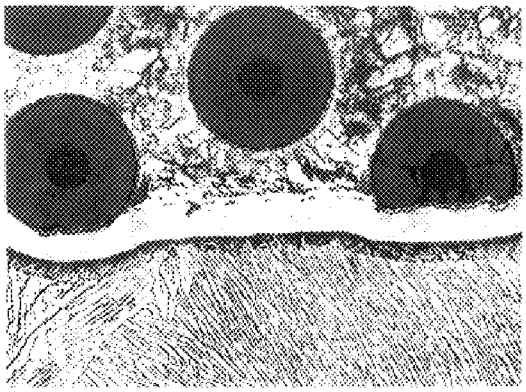
Figure 9B:
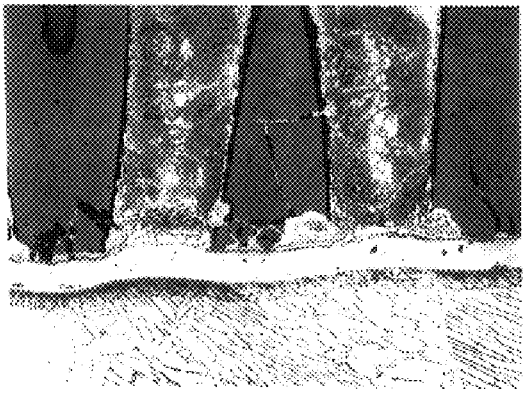
Figure 9D:
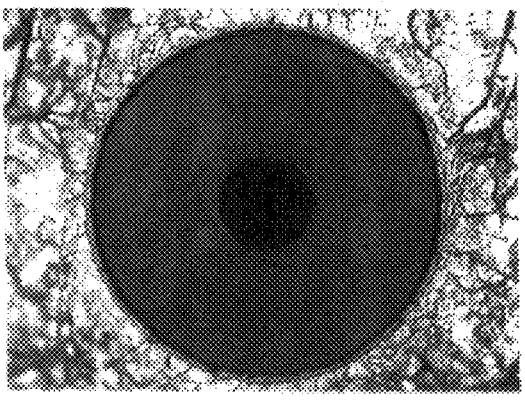
Figure 10A:
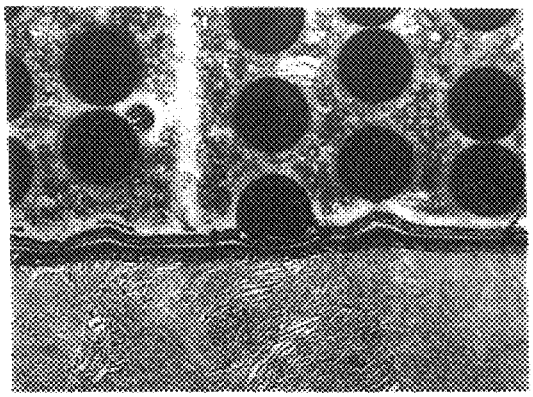
FIGS. 10*a*–10*d* are photomicrographs of a casting having a Nb clad reinforcement insert in accordance with another embodiment of the invention.
Figure 10C:
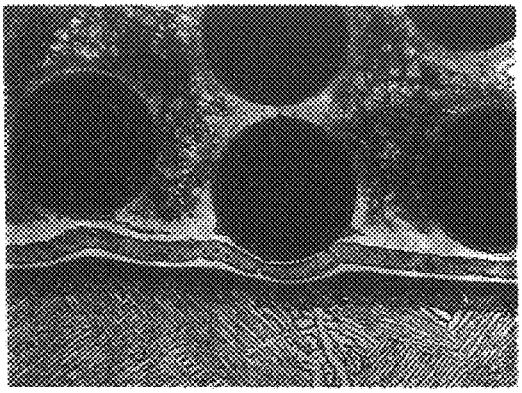
Figure 10B:
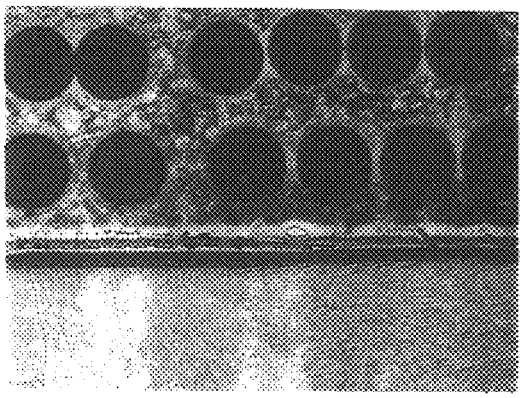
Figure 10D:
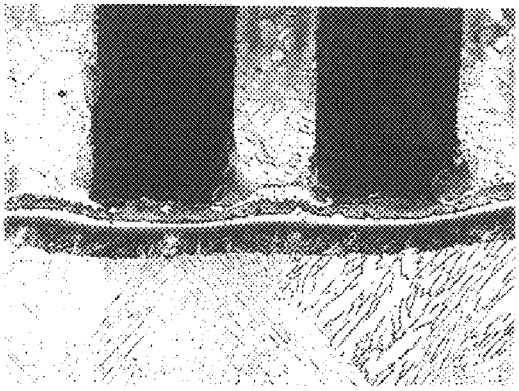
Figure 11A:
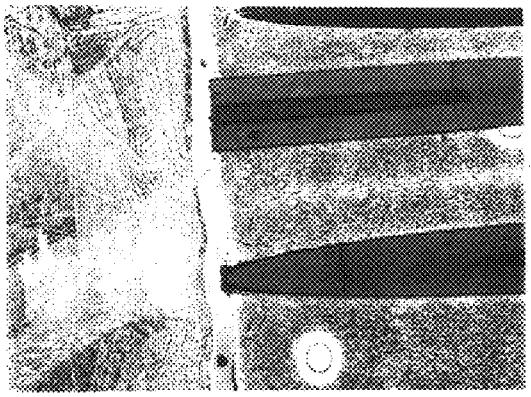
FIGS. 11*a*-11*b* are photomicrographs of a thermally cycled casting having a Ta clad reinforcement insert in accordance with another embodiment of the invention.
Figure 11B:
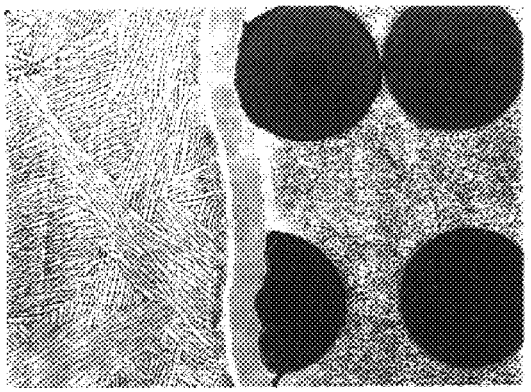
Figure 12A:
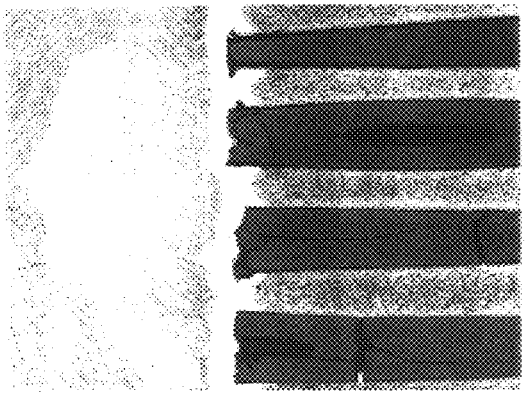
FIGS. 12*a*-12*b* are photomicrographs of a thermally cycled casting having a Nb clad reinforcement insert in accordance with another embodiment of the invention.
Figure 12B:
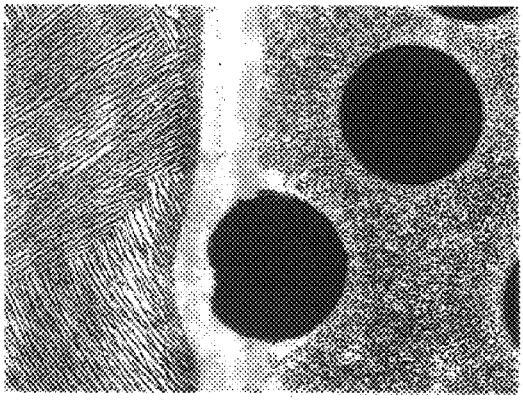

FIG. 8 shows the typical fiber/matrix reaction zone in these castings after HIP'ing. By comparing the reaction zone with that observed in the as-received panel, FIGS. 4*a*-4*b*, it is evident that the reaction zone has grown from about 0.5 microns to about 3.0 microns in thickness. However, this reaction zone growth produced only a minimal effect on fiber strength. Namely, except for the outermost 2 to 3 fiber layers, the measured fiber strengths fall close to the aforementioned baseline fiber strengths for the as-received panels.

Thus, in accordance with one embodiment of the invention, the ratio of the volume of the mold cavity (molten metal) to the volume of the preformed reinforcement insert is maintained about 16:1 or less to produce bicastings reinforced with an unclad reinforcement insert; i.e. the reinforcement insert is exposed to the melt cast and solidified thereabout during the bicasting process without cladding. Above this ratio, the fiber reinforced metal matrix composite reinforcement insert will suffer substantial damage including partial or total dissolution by the melt.

In accordance with another embodiment of the invention, the reinforcement insert is clad or covered with a protective material prior to positioning of the insert in the mold cavity to form the bicasting.

Bicastings in accordance with this embodiment of the invention wherein the reinforcement insert is protectively clad or covered were made using a TMC (titanium matrix composite) panel as the reinforcement insert precursor material. In particular, a TMC panel was used comprising 30.5 centimeters by 30.5 centimeters by 8 ply unidirectional SCS-6/beta-21S panel having the aforementioned SiC fibers coated with respective C/SiC layers in a beta titanium 21S matrix commercially available from Timet Corporation, Albany, Oregon.

Figure 5A:
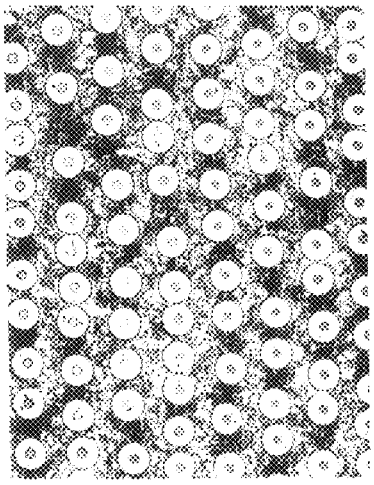
FIG. 5A PRIOR ART
FIGS. 5*a*–5*c* are photomicrographs at 50×, 200×, and 500×, respectively, of another different type of as-received titanium matrix composite microstructures used as reinforcement inserts in the casting trials described herein. The photomicrographs are taken of the microstructure transverse to the long fiber direction or axis.
Figure 5B:
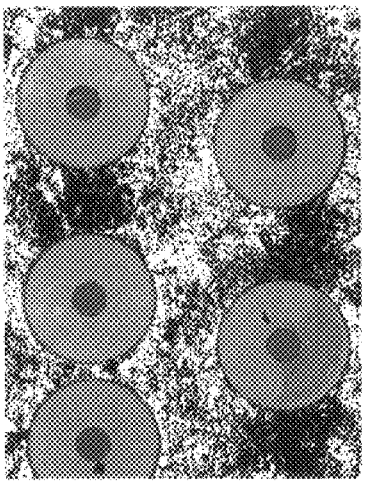
FIG. 5B PRIOR ART
Figure 5C:
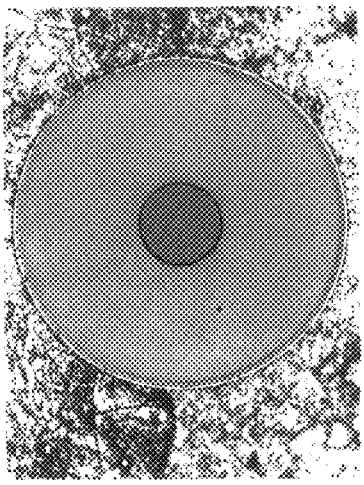
FIG. 5C PRIOR ART

FIGS. 5*a*–5*c* illustrate the microstructure of this as-received panel. Typically, the panel showed fairly uniform fiber arrays with some fiber contacts. Reaction zones surrounding the fibers were typically on the order of 0.5 microns in thickness. Fiber strengths were determined in the manner described above and is set forth below:

Panel 1 513 ksi tensile strength 96 ksi deviation

The panel was chemically milled and cleaned of the Mo reaction layer in the manner described above for the first embodiment of the invention.

Reinforced bicastings were produced by centrifugally casting a single mold to provide a ratio of mold cavity volume to insert volume of about 16:1.

The mold included 8 HIP'ed TMC reinforcement inserts each comprising 24-plies (24 panel strips) and each having dimensions of 15 centimeters by 1.8 centimeters by 0.5 centimeter. The HIP'ed TMC reinforcement inserts were fabricated using the same processing procedures as described above for the unclad reinforcement inserts of the first embodiment of the invention. However, 4 HIP'ed reinforcement inserts were then clad in 1 mil Ta foil, and 4 HIP'ed reinforcement inserts were then clad in 1 mil Nb foil. In both cases, the foil cladding was spot welded to the HIP'ed (preformed bar) reinforcement inserts in an inert gas atmosphere glove box. Alternately, a Nb, Ta or other refractory metal coating can be used as cladding.

Both Ta and Nb are strong beta phase stabilizers in titanium alloys and provide relatively ductile beta stabilized regions at the interface between the preformed bar insert and melt cast and solidified thereabout. Further, both types of cladding will limit the interdiffusion between the Ti matrix and the SiC fibers exposed by machining of the inserts during the elevated temperatures of bicasting.

The casting mold used for the casting trials was produced using conventional lost wax procedures. The mold employed bottom gating/top venting as shown in the schematic FIGS. 1*a*-1*b* for the first embodiment of the invention. However, as mentioned above, a ratio of mold cavity volume to insert volume of about 16:1 was provided. Each clad TMC preformed bar insert (constituting a clad preformed titanium matrix composite reinforcement insert) was held in place in the respective mold cavity using a pair of Ti-6 Al-4 V pins (diameter of 0.060 inch) welded to the cladding at opposite ends of the bars in a manner similar to the first embodiment of the invention. The slender pins centered or suspended each clad preformed bar insert in the respective casting mold cavity of the mold as described in copending Ser. No. 08/002 104, now U.S. Pat. No. 5,241,736 and 07/672 945, now abandoned, of common assignee herewith.

The molds were static cast in Ti-6 Al-4 V alloy VAR melted to a casting temperature of alloy melting point plus 50° F. with the molds preheated to 600° F. Casting was under vacuum.

After melt solidification, the cast molds were knocked out to free the bicastings for water blasting to remove the shell mold remaining thereon. The bicastings were trimmed to remove residual gating. The resulting plate-shaped bicastings were HIP'ed at 1650° F. at 15 ksi for 2 hours to provide a sound, void-free metallurgical bond between the preformed bar inserts and the solidified melt thereabout.

One plate-shaped casting from each group (Ta clad and Nb clad) was microstructurally characterized in the HIP'ed condition to examine the nature of the interfacial interactions between the clad reinforcement insert and cast Ti-6 Al-4 V melt. Fiber specimens were taken from one of the castings for tensile testing. Moreover, individual castings from each group were cycled in a vacuum furnace between 500° F. and 1500° F. for 50 and 100 cycles to determine the effect on bond integrity and interfacial reactions. The cycle consisted of heating to 1500° F. at a rate of 33° F. per minute, holding at that temperature for 5 minutes, and then gas fan cooling to 500° F.

Examination of the bicastings made in accordance with this embodiment of the invention revealed that only one casting was defective as a result of failure of two of the welded suspension pins positioning the insert in the mold cavity. The other castings were deemed acceptable.

Metallographic examination of the remaining HIP'ed castings revealed very little interaction between the preformed bar inserts and the cast (solidified) melt as illustrated in FIGS. 9*a*–9*d* and 10*a*–10*d*. Both the Ta and Nb cladding also were successful in limiting interactions between the matrix and the exposed fibers at previously machined fiber sites where the C/SiC coating was removed. The Ta clad inserts appeared to generate a slightly smaller beta stabilized zone or region in the adjacent insert matrix and solidified melt than the Nb clad inserts.

A HIP'ed casting having a Ta clad insert therein was chemically etched to remove the matrix so that the fibers could be tensile tested. The average strength of the individual fibers was about 478 ksi, which is little changed from the fiber strength (513 ksi) set forth above for the as-received panel.

With respect to the thermal cycling tests, neither the 50 cycle or 100 cycle test produced any significant changes in the interfacial microstructures and no interfacial cracking between the insert and the cast melt. FIGS. 11*a*-11*b* and 12*a*-12*b* show illustrative interfaces between machined fibers and the cast melt after 100 cycles to 1500° F. for castings having Ta and Nb clad inserts, respectively.

Thus, in accordance with the second described embodiment of the invention, cladding of the reinforcement insert was advantageous to virtually eliminate interaction between the insert/melt and any machined fibers/metal matrix and to survive thermal cycling with no apparent harmful effect to the insert/casting interface.

In practicing the present invention as described in detail hereinabove, a preformed titanium aluminide (e.g. TiAl) reinforcement insert can be used in lieu of the preformed fiber reinforced titanium matrix reinforcement insert to reinforce the Ti-6 Al-4 V (or other titanium based alloy or metal) casting. Other intermetallic reinforcement inserts can also be used.

Although the invention has been shown and described with respect to certain embodiments thereof, it will be understood by those skilled in the art that various changes and modifications in form and detail thereof may be made without departing from the spirit and scope of the invention as set forth in the appended claims.

We claim:

1. A composite casting, comprising a titanium based reinforcement insert embedded in a titanium based melt solidified thereabout and having cladding comprising a beta titanium phase stabilizer between the insert and solidified melt and reacted with the titanium based insert to provide a beta stabilized region between the insert and solidified melt.

2. The composite casting of claim 1 wherein the cladding comprises Nb or Ta.

3. The composite casting of claim 2 wherein the cladding comprises Nb or Ta foil.

4. A composite casting, comprising a titanium based reinforcement insert embedded in a titanium based melt solidified thereabout wherein the ratio of the volume of the solidified melt to the volume of the insert is about 16:1 or less.

5. The casting of claim 4 wherein the insert comprises a fiber reinforced titanium based matrix composite.

6. The casting of claim 4 wherein the insert comprises titanium aluminide.

* * * * *